US006215379B1

(12) United States Patent
O'Keefe et al.

(10) Patent No.: US 6,215,379 B1
(45) Date of Patent: Apr. 10, 2001

(54) SHUNT FOR INDIRECTLY HEATED BIMETALLIC STRIP

(75) Inventors: Thomas O'Keefe, Farmington; Alan Arvidson, Burlington; James Fulton, Canton, all of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/471,926

(22) Filed: Dec. 23, 1999

(51) Int. Cl.[7] ..... H01H 75/12
(52) U.S. Cl. ..... 335/35; 335/172
(58) Field of Search ..... 335/23–25, 35, 335/37, 38, 167–176, 43, 45; 337/16, 14

(56) References Cited

U.S. PATENT DOCUMENTS

| | | |
|---|---|---|
| D. 367,265 | 2/1996 | Yamagata et al. . |
| 2,340,682 | 2/1944 | Powell . |
| 2,719,203 | 9/1955 | Gelzheiser et al. . |
| 2,937,254 | 5/1960 | Ericson . |
| 3,158,717 | 11/1964 | Jencks et al. . |
| 3,162,739 | 12/1964 | Klein et al. . |
| 3,197,582 | 7/1965 | Norden . |
| 3,307,002 | 2/1967 | Cooper . |
| 3,517,356 | 6/1970 | Hanafusa . |
| 3,631,369 | 12/1971 | Menocal . |
| 3,803,455 | 4/1974 | Willard . |
| 3,883,781 | 5/1975 | Cotton . |
| 4,129,762 | 12/1978 | Bruchet . |
| 4,144,513 | 3/1979 | Shafer et al. . |
| 4,158,119 | 6/1979 | Krakik . |
| 4,165,453 | 8/1979 | Hennemann . |
| 4,166,988 | 9/1979 | Ciarcia et al. . |
| 4,220,934 | 9/1980 | Wafer et al. . |
| 4,255,732 | 3/1981 | Wafer et al. . |

(List continued on next page.)

FOREIGN PATENT DOCUMENTS

| | | |
|---|---|---|
| 819 008 | 12/1974 | (BE) . |
| 12 27 978 | 11/1966 | (DE) . |
| 30 47 360 | 6/1982 | (DE) . |
| 38 02 184 | 8/1989 | (DE) . |
| 38 43 277 | 6/1990 | (DE) . |
| 44 19 240 | 1/1995 | (DE) . |
| 0 061 092 | 9/1982 | (EP) . |
| 0 064 906 | 11/1982 | (EP) . |
| 0 066 486 | 12/1982 | (EP) . |
| 0 076 719 | 4/1983 | (EP) . |
| 0 117 094 | 8/1984 | (EP) . |
| 0 140 761 | 5/1985 | (EP) . |
| 0 174 904 | 3/1986 | (EP) . |
| 0 196 241 | 10/1986 | (EP) . |
| 0 224 396 | 6/1987 | (EP) . |
| 0 235 479 | 9/1987 | (EP) . |
| 0 239 460 | 9/1987 | (EP) . |
| 0 258 090 | 3/1988 | (EP) . |
| 0 264 313 | 4/1988 | (EP) . |
| 0 264 314 | 4/1988 | (EP) . |
| 0 283 189 | 9/1988 | (EP) . |
| 0 283 358 | 9/1988 | (EP) . |
| 0 291 374 | 11/1988 | (EP) . |
| 0 295 155 | 12/1988 | (EP) . |
| 0 295 158 | 12/1988 | (EP) . |
| 0 309 923 | 4/1989 | (EP) . |
| 0 313 106 | 4/1989 | (EP) . |
| 0 313 422 | 4/1989 | (EP) . |
| 0 314 540 | 5/1989 | (EP) . |

(List continued on next page.)

*Primary Examiner*—Lincoln Donovan
*Assistant Examiner*—Tuyen T. Nguyen
(74) *Attorney, Agent, or Firm*—Cantor Colburn LLP; Carl B. Horton

(57) ABSTRACT

A shunt (heater strap) (36) for a bimetallic strip (34) is presented. The shunt (36) has a section of reduced thickness (70) for the generation of a localized hot spot. The bimetallic strip (34) is attached to the shunt (36) at the reduced thickness section (70).

8 Claims, 5 Drawing Sheets

U.S. PATENT DOCUMENTS

| | | | |
|---|---|---|---|
| 4,259,651 | | 3/1981 | Yamat . |
| 4,263,492 | | 4/1981 | Maier et al. . |
| 4,276,527 | | 6/1981 | Gerbert-Gaillard et al. . |
| 4,297,663 | | 10/1981 | Seymour et al. . |
| 4,301,342 | | 11/1981 | Castonguay et al. . |
| 4,360,852 | | 11/1982 | Gilmore . |
| 4,368,444 | | 1/1983 | Preuss et al. . |
| 4,375,021 | | 2/1983 | Pardini et al. . |
| 4,375,022 | | 2/1983 | Daussin et al. . |
| 4,376,270 | | 3/1983 | Staffen . |
| 4,383,146 | | 5/1983 | Bur . |
| 4,392,036 | | 7/1983 | Troebel et al. . |
| 4,393,283 | | 7/1983 | Masuda . |
| 4,401,872 | | 8/1983 | Boichot-Castagne et al. . |
| 4,409,573 | | 10/1983 | DiMarco et al. . |
| 4,435,690 | | 3/1984 | Link et al. . |
| 4,467,297 | | 8/1984 | Boichot-Castagne et al. . |
| 4,468,645 | | 8/1984 | Gerbert-Gaillard et al. . |
| 4,470,027 | | 9/1984 | Link et al. . |
| 4,479,143 | | 10/1984 | Watanabe et al. . |
| 4,488,133 | | 12/1984 | McClellan et al. . |
| 4,492,941 | | 1/1985 | Nagel . |
| 4,539,545 | * | 9/1985 | Klotz ..... 337/380 |
| 4,541,032 | | 9/1985 | Schwab . |
| 4,546,224 | | 10/1985 | Mostosi . |
| 4,550,360 | | 10/1985 | Dougherty . |
| 4,562,419 | | 12/1985 | Preuss et al. . |
| 4,589,052 | | 5/1986 | Dougherty . |
| 4,595,812 | | 6/1986 | Tamaru et al. . |
| 4,611,187 | | 9/1986 | Banfi . |
| 4,612,430 | | 9/1986 | Sloan et al. . |
| 4,616,198 | | 10/1986 | Pardini . |
| 4,622,444 | | 11/1986 | Kandatsu et al. . |
| 4,631,625 | | 12/1986 | Alexander et al. . |
| 4,642,431 | | 2/1987 | Tedesco et al. . |
| 4,644,438 | | 2/1987 | Puccinelli et al. . |
| 4,649,247 | | 3/1987 | Preuss et al. . |
| 4,658,322 | | 4/1987 | Rivera . |
| 4,672,501 | | 6/1987 | Bilac et al. . |
| 4,675,481 | | 6/1987 | Markowski et al. . |
| 4,682,264 | | 7/1987 | Demeyer . |
| 4,689,712 | | 8/1987 | Demeyer . |
| 4,694,373 | | 9/1987 | Demeyer . |
| 4,710,845 | | 12/1987 | Demeyer . |
| 4,713,635 | * | 12/1987 | Flick et al. ..... 335/8 |
| 4,717,985 | | 1/1988 | Demeyer . |
| 4,733,211 | | 3/1988 | Castonguay et al. . |
| 4,733,321 | | 3/1988 | Lindeperg . |
| 4,755,787 | * | 7/1988 | Wehl ..... 337/372 |
| 4,764,650 | | 8/1988 | Bur et al. . |
| 4,768,007 | | 8/1988 | Mertz et al. . |
| 4,780,786 | | 10/1988 | Weynachter et al. . |
| 4,831,221 | | 5/1989 | Yu et al. . |
| 4,870,531 | | 9/1989 | Danek . |
| 4,883,931 | | 11/1989 | Batteux et al. . |
| 4,884,047 | | 11/1989 | Baginski et al. . |
| 4,884,164 | | 11/1989 | Dziura et al. . |
| 4,900,882 | | 2/1990 | Bernard et al. . |
| 4,910,485 | | 3/1990 | Bolongeat-Mobleu et al. . |
| 4,914,541 | | 4/1990 | Tripodi et al. . |
| 4,916,420 | | 4/1990 | Bartolo et al. . |
| 4,916,421 | | 4/1990 | Pardini et al. . |
| 4,926,282 | | 5/1990 | McGhie . |
| 4,935,590 | | 6/1990 | Malkin et al. . |
| 4,937,706 | | 6/1990 | Schueller et al. . |
| 4,939,492 | | 7/1990 | Raso et al. . |
| 4,943,691 | | 7/1990 | Mertz et al. . |
| 4,943,888 | | 7/1990 | Jacob et al. . |
| 4,950,855 | | 8/1990 | Bolonegeat-Mobleu et al. . |
| 4,951,019 | | 8/1990 | Gula . |
| 4,952,897 | | 8/1990 | Barnel et al. . |
| 4,958,135 | | 9/1990 | Baginski et al. . |
| 4,965,543 | | 10/1990 | Batteux . |
| 4,983,788 | | 1/1991 | Pardini . |
| 5,001,313 | | 3/1991 | Leclerq et al. . |
| 5,004,878 | | 4/1991 | Seymour et al. . |
| 5,029,301 | | 7/1991 | Nebon et al. . |
| 5,030,804 | | 7/1991 | Abri . |
| 5,057,655 | | 10/1991 | Kersusan et al. . |
| 5,077,627 | | 12/1991 | Fraisse . |
| 5,083,081 | | 1/1992 | Barrault et al. . |
| 5,095,183 | | 3/1992 | Raphard et al. . |
| 5,103,198 | | 4/1992 | Morel et al. . |
| 5,115,371 | | 5/1992 | Tripodi . |
| 5,120,921 | | 6/1992 | DiMarco et al. . |
| 5,132,865 | | 7/1992 | Mertz et al. . |
| 5,138,121 | | 8/1992 | Streich et al. . |
| 5,140,115 | | 8/1992 | Morris . |
| 5,153,802 | | 10/1992 | Mertz et al. . |
| 5,155,315 | | 10/1992 | Malkin et al. . |
| 5,166,483 | | 11/1992 | Kersusan et al. . |
| 5,172,087 | | 12/1992 | Castonguay et al. . |
| 5,178,504 | | 1/1993 | Falchi . |
| 5,184,717 | | 2/1993 | Chou et al. . |
| 5,187,339 | | 2/1993 | Lissandrin . |
| 5,198,956 | | 3/1993 | Dvorak . |
| 5,200,724 | | 4/1993 | Gula et al. . |
| 5,210,385 | | 5/1993 | Morel et al. . |
| 5,239,150 | | 8/1993 | Bolongeat-Mobleu et al. . |
| 5,260,533 | | 11/1993 | Livesey et al. . |
| 5,262,744 | | 11/1993 | Arnold et al. . |
| 5,280,144 | | 1/1994 | Bologeat-Mobleu et al. . |
| 5,281,776 | | 1/1994 | Morel et al. . |
| 5,296,660 | | 3/1994 | Morel et al. . |
| 5,296,664 | | 3/1994 | Crookston et al. . |
| 5,298,874 | | 3/1994 | Morel et al. . |
| 5,300,907 | | 4/1994 | Nereau et al. . |
| 5,310,971 | | 5/1994 | Vial et al. . |
| 5,313,180 | | 5/1994 | Vial et al. . |
| 5,317,471 | | 5/1994 | Izoard et al. . |
| 5,331,500 | | 7/1994 | Corcoles et al. . |
| 5,334,808 | | 8/1994 | Bur et al. . |
| 5,341,191 | | 8/1994 | Crookston et al. . |
| 5,347,096 | | 9/1994 | Bolongeat-Mobleu et al. . |
| 5,347,097 | | 9/1994 | Bolongeat-Mobleu et al. . |
| 5,350,892 | | 9/1994 | Rozier . |
| 5,357,066 | | 10/1994 | Morel et al. . |
| 5,357,068 | | 10/1994 | Rozier . |
| 5,357,394 | | 10/1994 | Piney . |
| 5,361,052 | | 11/1994 | Ferullo et al. . |
| 5,373,130 | | 12/1994 | Barrault et al. . |
| 5,379,013 | | 1/1995 | Coudert . |
| 5,424,701 | | 6/1995 | Castonguary et al. . |
| 5,438,176 | | 8/1995 | Bonnardel et al. . |
| 5,440,088 | | 8/1995 | Coudert et al. . |
| 5,449,871 | | 9/1995 | Batteux et al. . |
| 5,450,048 | | 9/1995 | Leger et al. . |
| 5,451,729 | | 9/1995 | Onderka et al. . |
| 5,457,295 | | 10/1995 | Tanibe et al. . |
| 5,467,069 | | 11/1995 | Payet-Burin . |
| 5,469,121 | | 11/1995 | Payet-Burin . |
| 5,475,558 | | 12/1995 | Barjonnet et al. . |
| 5,477,016 | | 12/1995 | Baginski et al. . |
| 5,479,143 | | 12/1995 | Payet-Burin . |
| 5,483,212 | | 1/1996 | Lankuttis et al. . |
| 5,485,343 | | 1/1996 | Santos et al. . |
| 5,493,083 | | 2/1996 | Olivier . |
| 5,504,284 | | 4/1996 | Lazareth et al. . |
| 5,504,290 | | 4/1996 | Baginski et al. . |
| 5,510,761 | | 4/1996 | Boder et al. . |
| 5,512,720 | | 4/1996 | Coudert et al. . |

| | | | |
|---|---|---|---|
| 5,515,018 | 5/1996 | DiMarco et al. . | |
| 5,519,561 | 5/1996 | Mrenna et al. . | |
| 5,534,674 | 7/1996 | Steffens . | |
| 5,534,832 | 7/1996 | Duchemin et al. . | |
| 5,534,835 | 7/1996 | McColloch et al. . | |
| 5,534,840 | 7/1996 | Cuingnet . | |
| 5,539,168 | 7/1996 | Linzenich . | |
| 5,543,595 | 8/1996 | Mader et al. . | |
| 5,552,755 | 9/1996 | Fello et al. . | |
| 5,581,219 | 12/1996 | Nozawa et al. . | |
| 5,604,656 | 2/1997 | Derrick et al. . | |
| 5,608,367 | 3/1997 | Zoller et al. . | |
| 5,784,233 | 7/1998 | Bastard et al. . | |
| 5,796,327 * | 8/1998 | Smith | 337/342 |

FOREIGN PATENT DOCUMENTS

| | | |
|---|---|---|
| 0 331 586 | 9/1989 | (EP) . |
| 0 337 900 | 10/1989 | (EP) . |
| 0 342 133 | 11/1989 | (EP) . |
| 0 367 690 | 5/1990 | (EP) . |
| 0 371 887 | 6/1990 | (EP) . |
| 0 375 568 | 6/1990 | (EP) . |
| 0 394 144 | 10/1990 | (EP) . |
| 0 394 922 | 10/1990 | (EP) . |
| 0 399 282 | 11/1990 | (EP) . |
| 0 407 310 | 1/1991 | (EP) . |
| 0 452 230 | 10/1991 | (EP) . |
| 0 555 158 | 8/1993 | (EP) . |
| 0 560 697 | 9/1993 | (EP) . |
| 0 567 416 | 10/1993 | (EP) . |
| 0 595 730 | 5/1994 | (EP) . |
| 0 619 591 | 10/1994 | (EP) . |
| 0 665 569 | 8/1995 | (EP) . |
| 0 700 140 | 3/1996 | (EP) . |
| 0 889 498 | 1/1999 | (EP) . |
| 2 410 353 | 6/1979 | (FR) . |
| 2 512 582 | 3/1983 | (FR) . |
| 2 553 943 | 4/1985 | (FR) . |
| 2 592 998 | 7/1987 | (FR) . |
| 2 682 531 | 4/1993 | (FR) . |
| 2 697 670 | 5/1994 | (FR) . |
| 2 699 324 | 6/1994 | (FR) . |
| 2 714 771 | 7/1995 | (FR) . |
| 2 233 155 | 1/1991 | (GB) . |
| 92/00598 | 1/1992 | (WO) . |
| 92/05649 | 4/1992 | (WO) . |
| 94/00901 | 1/1994 | (WO) . |

* cited by examiner

SHUNT FOR INDIRECTLY HEATED BIMETALLIC STRIP

BACKGROUND OF THE INVENTION

This invention relates to the subject of shunts for indirectly heated bimetallic strips. While especially suitable for use in circuit breakers, the shunt of this invention is useful for heating any bimetallic strip.

Circuit breakers employing indirectly heated bimetallic strips are well known. A shunt, or heater strap, is attached to one end of a bimetallic strip via brazing, rivets, or screws. Electrical current from a distribution circuit passes through the shunt. When an overcurrent condition occurs, the shunt generates heat, which is transferred to the bimetallic strip across the junction of the shunt and the bimetallic strip. The bimetallic strip is formed of two metals having different coefficients of expansion such that a free end of the bimetallic strip bends or deflects when the temperature of the bimetallic strip exceeds a predetermined temperature. If the temperature of the bimetallic strip exceeds the predetermined value, the free end of the bimetallic strip deflects to actuate a linkage interconnected to a pair of separable contacts within the circuit breaker. The linkage then opens the pair of contacts to interrupt the current and, thereby, protect a load from the overcurrent condition.

Circuit breakers employing such indirectly heated bimetallic strips are well known. However, it is desirable to reduce the response time in obtaining the desired temperature distribution through the shunt and bimetallic strip and, thereby, reduce the amount of time to trip the breaker on an overcurrent condition. It is also desirable to reduce or eliminate the temperature hot spots at the extreme ends of the shunt. Attempts have been made in the prior art to address these deficiencies, such as by creating circular, rectangular or slotted openings in the shunt. While effective to some degree, these prior art approaches still leave room for improvement.

BRIEF SUMMARY OF THE INVENTION

In an exemplary embodiment of the invention, a shunt for a bimetallic strip is formed from a length of electrical and heat conductive material having a thickness of "t" throughout most of its length. A section of reduced thickness in the length of electrical and heat conductive material has a thickness ranging from 20% to 80% of the thickness "t". This reduced thickness section produces a localized hot area, which decreases the time required to reach a predetermined temperature in both the shunt, at this localized hot spot, and in the bimetallic strip, and reduces the trip time of the rated circuit. The localized hot spot in the shunt results in increased temperatures along the bimetallic strip. This, in turn, increases the deflection of the bimetallic strip, for greater actuating force or greater range of movement. As a result of the greater range of movement, the gap between the bimetallic strip and the circuit breaker trip bar can be increased to reduce nuisance tripping.

BRIEF DESCRIPTION OF THE DRAWINGS

Referring to the drawings, wherein like elements are numbered alike in the several figures.

DETAILED DESCRIPTION OF THE INVENTION

Figure 1:
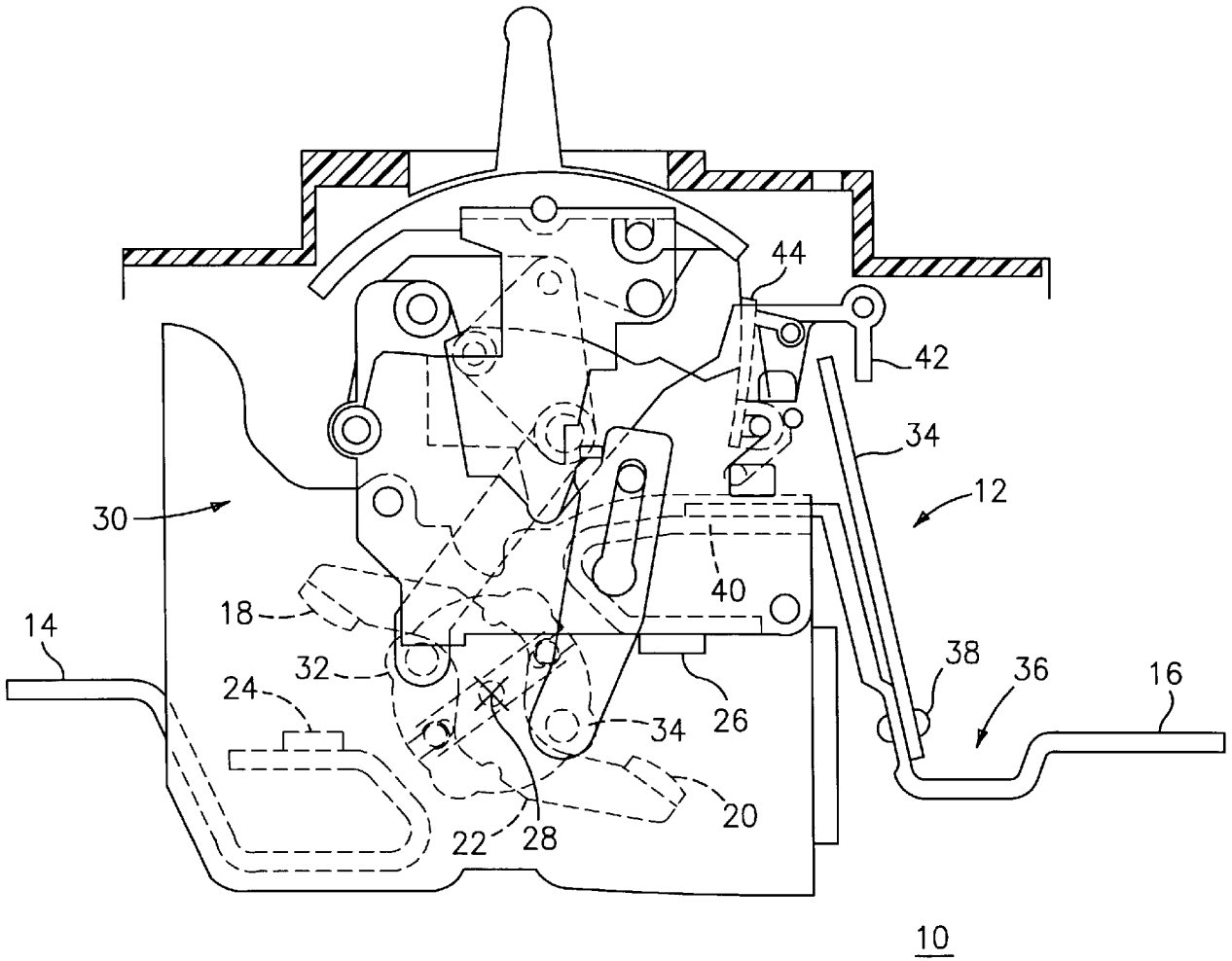
FIG. 1 is a side view of a circuit breaker including a shunt of the present invention.

Referring to FIG. 1, an embodiment of a circuit breaker, generally shown at 10, includes a thermal trip unit 12. Circuit breaker 10 is electrically connected to an electrical distribution circuit (not shown) via line and load side connections 14, 16 to provide overcurrent protection to the distribution circuit. Circuit breaker 10 includes a pair of moveable contacts 18, 20, disposed on opposite ends of rotating contact arm 22. The moveable contacts 18, 20 are in opposing alignment to fixed contacts 24, 26 respectively. The rotating contact arm 22 is mounted pivotally to the circuit breaker frame at 28. The rotating contact arm 22 engages a circuit breaker operating mechanism 30 at a pair of pivotal engagements 32, 34 that are interposed between the moveable contacts 18, 20.

The thermal trip portion 12 includes a bimetallic strip 34 having one end attached to a shunt 36 by a rivet 38. While a rivet 38 is shown for connecting bimetallic strip 34 to shunt 36, bimetallic strip 34 may be connected to shunt (heater strap) 36 by brazing, screws, or by any other means known in the art. Shunt 36 is electrically connected to a contact strap 40 at one end of shunt 36. The other end of shunt 36 forms load-side connection 16, which is electrically connected to the electrical distribution circuit.

The operating mechanism 30 includes a series of linkages and levers for interconnecting the rotating contact arm 22 and the thermal trip unit 12. Lever 42 cooperates with the thermal trip unit 12 to actuate a trip latch 44 of operating mechanism 30 and separate the movable contacts 18, 20 from the fixed contacts 24, 26.

The bimetallic strip 34 provides the thermal trip for an overcurrent condition. Increased current generates heat in the shunt 36 which further heats-up the bimetallic strip 34. When the temperature of the bimetallic strip 34 exceeds a predetermined set point, the free end of the bimetallic strip 34 deflects to engage lever 42, which releases the trip latch 44 of operating mechanism 30. Operating mechanism 30 then separates the movable contacts 18, 20 from the fixed contacts 24, 26 to interrupt the current and, thereby, protect the load side of the distribution circuit from the overcurrent condition.

Figure 2:
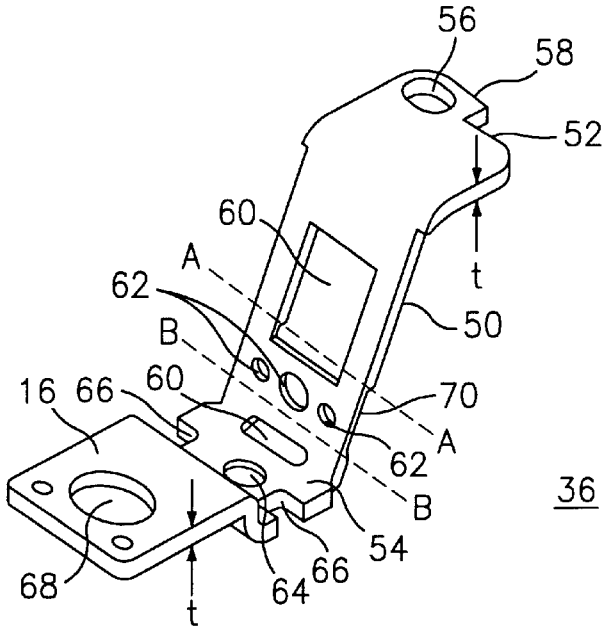
FIG. 2 is a perspective view of the shunt of FIG. 1.

FIG. 2 is a perspective view of shunt 36. Shunt 36 is constructed of electrical and heat conducting material such as copper or aluminum and is formed in a desired shape depending on the circuit breaker in which it is to be used. Preferably, shunt 36 is constructed of a copper material with some copper derivative such as titanium, brass, tin, or chromium. As shown, shunt 36 has a generally vertical main body portion 50, an upper generally horizontal section 52, a lower generally horizontal section 54, and load-side connection section 16, which is generally horizontal. Upper section includes an aperture 56 formed on a tab 58 extending from upper section 52, allowing connection between shunt 36 and contact strap 40 (FIG. 1). Main body section 50 includes elongated slots 60 and apertures 62 disposed in a central portion thereof. Aperture 62 allow for a rivet connection between shunt 36 and bimetallic strip 34 (FIG. 1).

Elongated slots 60 help to increase the temperature of shunt 36 at a location between the elongated slots 60. Lower section 54 includes an aperture 64 formed in a central portion thereof and slots 66 extending from side edges thereof. Aperture 64 and slots 66 allow for mounting of shunt 36 within the circuit breaker. An aperture 68 formed in load-side section 16 allows for connection with a phase of an electrical distribution circuit. The overall shape shown in the drawings is illustrative and is not required for the invention. Tab 58, apertures 56, 62, 64, 68, and slots 60, 66 are optional. Such tabs, apertures, slots and the like may be added or removed depending on the circuit breaker in which shunt 36 is to be used.

Figure 3:
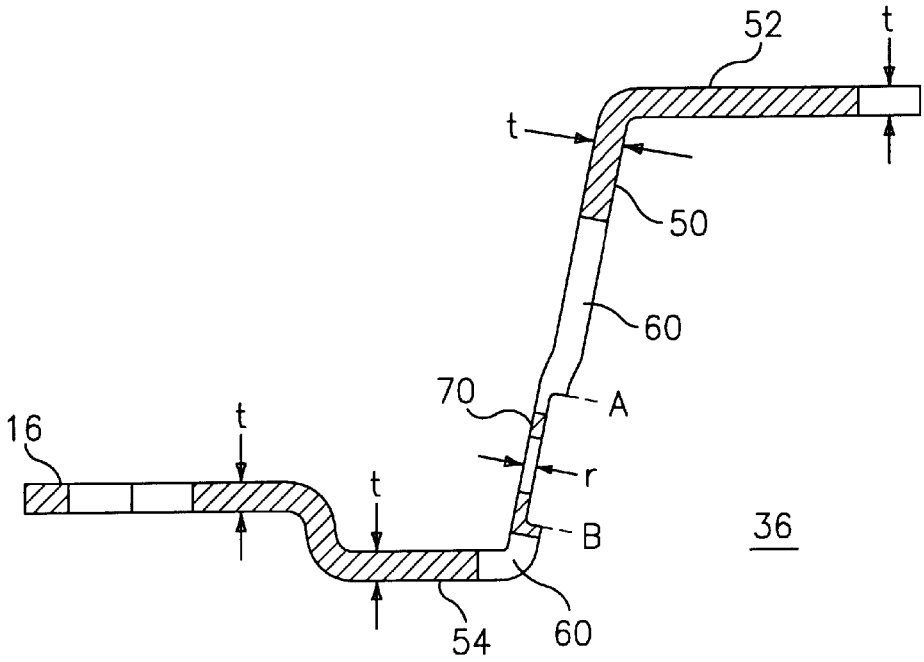
FIG. 3 is a cross-sectional elevation view of the shunt of FIG. 1.

The thickness "t" of the material forming shunt 36 is essentially constant throughout the entire extent of shunt 36 except in the area 70 defined between lines A and B. Area 70 extends the entire width of heater strap 10. As is best seen in the cross-sectional view of shunt 36 shown in FIG. 3, the thickness "r" of the shunt in area 70 is reduced to a thickness in the range of 20% to 80% of the thickness "t".

Figure 4:
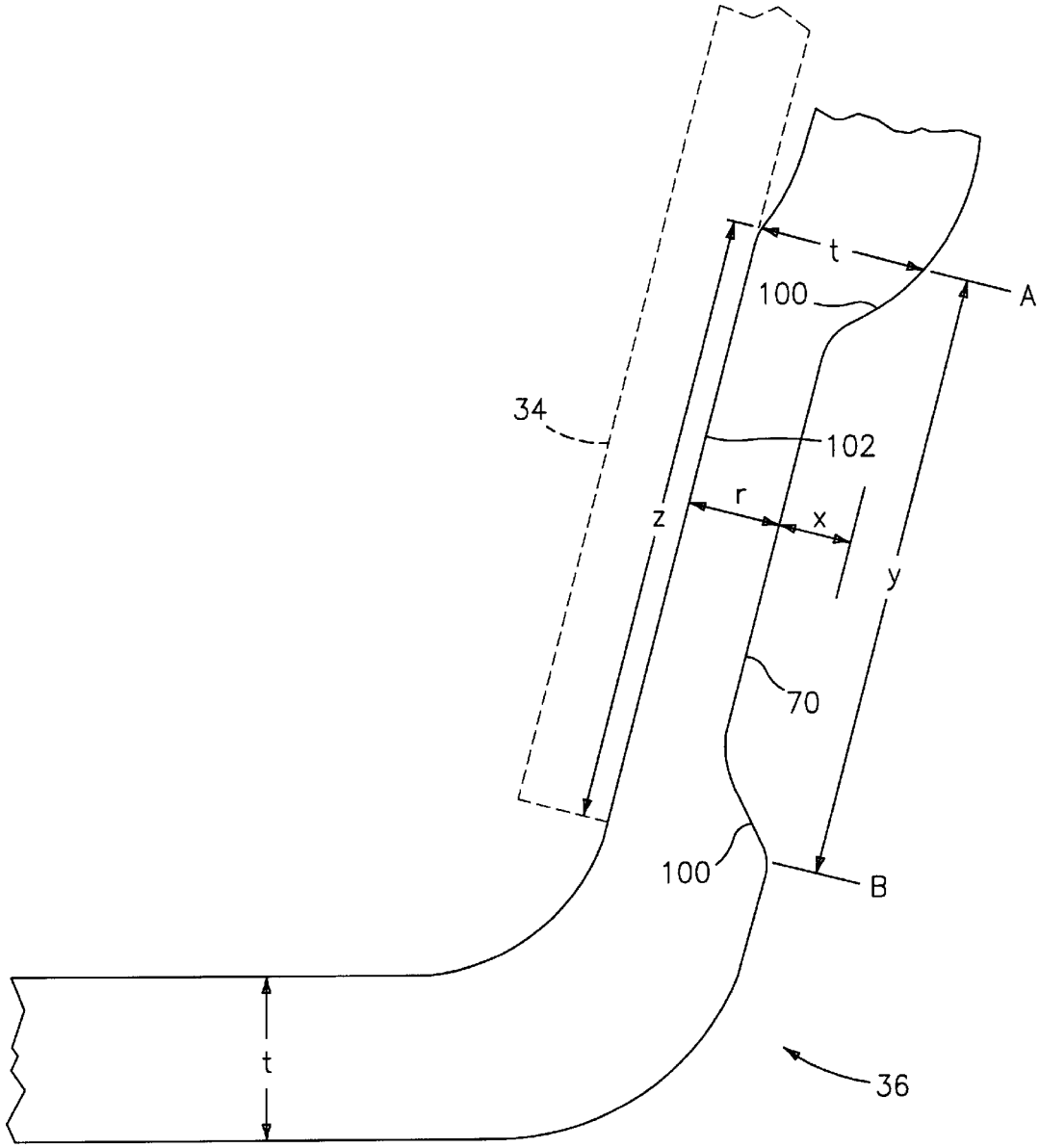
FIG. 4 is an enlarged view of the reduced thickness area of the shunt of FIG. 3.

FIG. 4 is an enlarged view of the reduced thickness section 70 of shunt 36. In a preferred embodiment, the transition zones 100 from the full thickness "t" parts of the shunt to the reduced thickness "r" section 70 are gradual slopes. However, shunt 10 may also be constructed with no transition zones 100. That is, the transition from full thickness "r" to reduced thickness section 70 is a sharp decrease. The distance from full thickness point A to full thickness point B is designated by "y". Also, the thickness "r" of the fully reduced thickness section 18 is equal to t−x, where "x" is the amount of conductive material removed from the full thickness "t" of the shunt. Bimetallic strip 34, shown in phantom, contacts a surface 102 of reduced thickness section 70 of shunt 36. Surface 102 is formed on a side of shunt 36 opposite the side from which conductive material is removed. Shunt 36 and strip 34 are in contact over a distance "z" along surface 102. Conductive heat transfer from shunt 36 to bimetallic strip 34 is made across this portion of surface 102. It can be seen that the distance "y" and the distance "z" are overlapping. That is, a portion of the reduced thickness section 70 (A-B) is in contact with bimetallic strip 34. In the embodiment shown, the distance "y" is approximately equal to the distance "z". However, the distance "y" can range from 3% to 200% of the distance "z".

Figure 5:
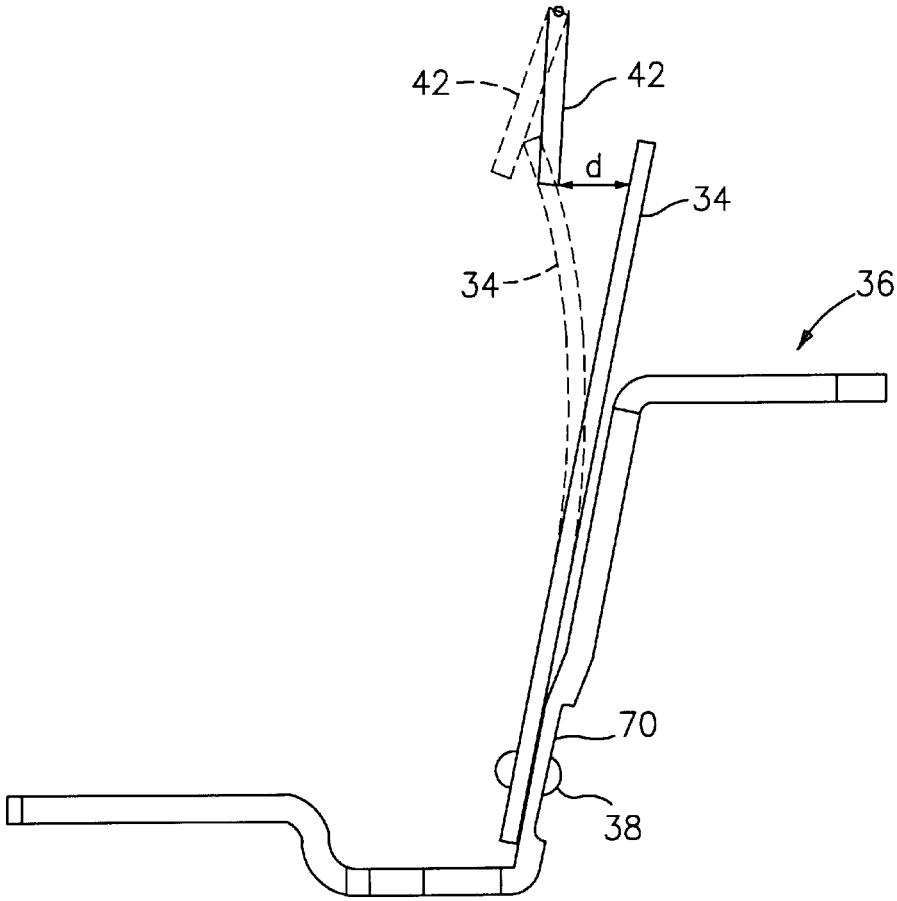
FIG. 5 is a side elevation view similar to FIG. 3 and showing a bimetallic strip attached to the shunt.

FIG. 5 is a side view of a bimetallic strip 34 attached to shunt 36 at the reduced thickness area 70. The full-line position of bimetallic strip 34 shown in FIG. 5 is the unheated or low level heat condition commensurate with no current flow through shunt 36. Bimetallic strip 34 is normally spaced a predetermined distance "d" from arm 42 of the circuit breaker operating mechanism 30 (see FIG. 1). When electrical current flows through shunt 36, heat from shunt 36 transfers to bimetallic strip 34 via the connection between shunt 36 and bimetallic strip 34 at area 70. When the temperature of the bimetallic strip 34 reaches a predetermined limit, the bimetallic strip 22 deflects from the full line position to the dashed line position to contact arm 58, thereby causing the circuit breaker to open and prevent a circuit overload. The amount of heat, and hence the degree of deflection of bimetallic strip 34, is a function of the temperature distribution through shunt 36.

The addition of reduced section 70 to shunt 36 results in a "hot spot" of increased localized temperature in the shunt at section 70. This increased temperature translates directly into an increase in the deflection of bimetallic strip 34 for any given current level. This increased temperature and increased deflection occur for both steady state and transient current flow in shunt 36. The increased temperature is localized to reduced section 70, and lower temperatures prevail in the remainder of shunt 36. Thus, the shunt of the present invention is a clear improvement over the prior art in that the shunt of the present invention reduces the temperature hot spots at the extreme ends of the shunt and contains the hot spot in a preferred location.

The increased deflection of bimetallic strip 34 resulting from the increased temperature of hot spot 70 results in a greater range of deflection and/or a greater actuating force for a given current flow. Therefore, the steady-state distance "d" between the bimetallic strip 34 and arm 42 can be increased. This reduces nuisance tripping. Also, the localized hot spot of the reduced section 70 has the unexpected result of reducing trip time on first operation and in surge conditions.

Figure 6:
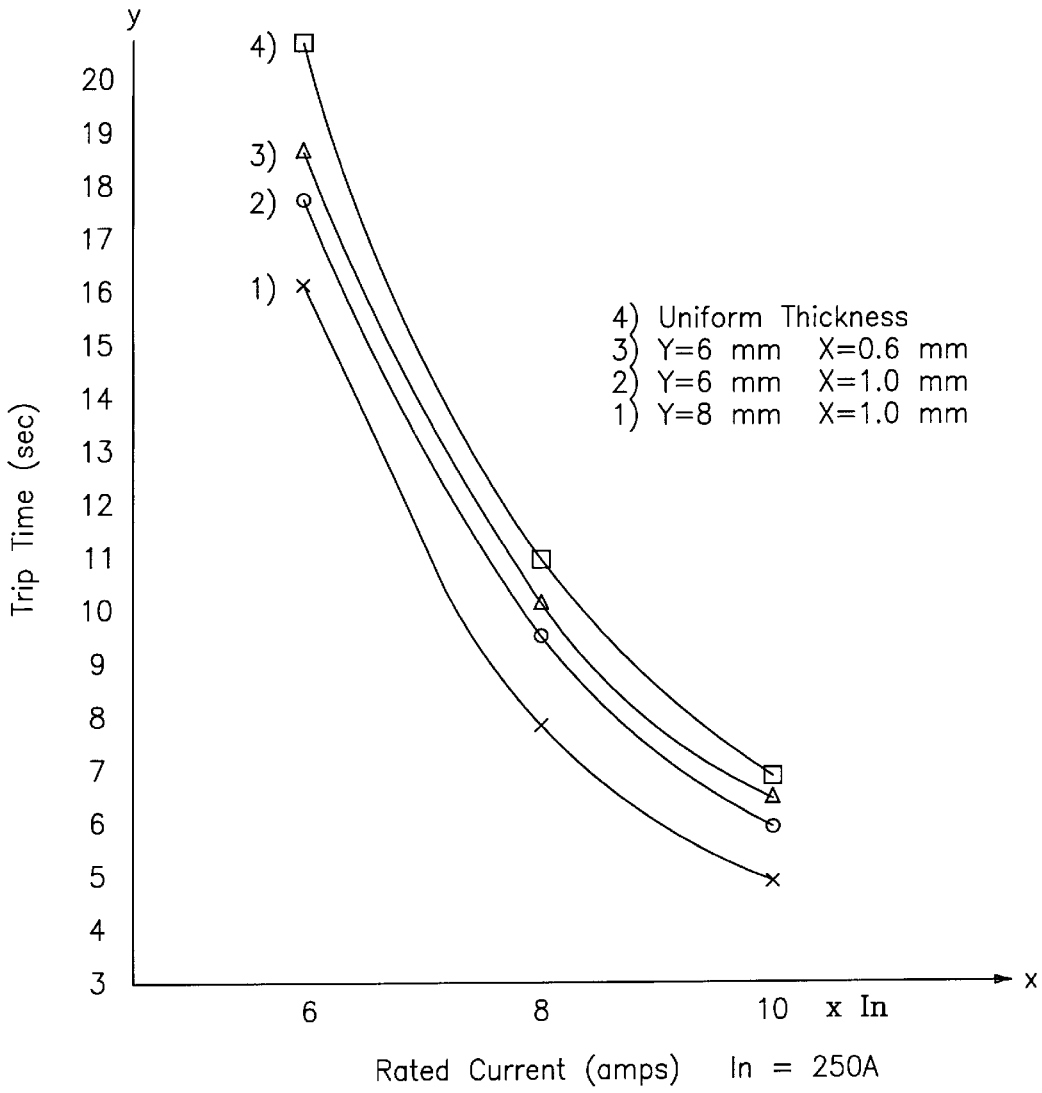
FIG. 6 is a is a graph showing circuit breaker trip time as a function of rated current for comparison of the present invention with the prior art.

FIG. 6 is a graph showing circuit breaker trip time as a function of rated current for various shunt designs. Multiples of a 250 amp rms rated current are plotted on the X axis, and trip time in seconds is plotted on the Y axis. Curve 4 represents the trip time for a prior art shunt having a uniform thickness of 1.8 to 2.2 millimeters. Curve 3 represents the trip time for a shunt of the present invention having a thickness of 1.8 to 2.2 millimeters, a dimension "y" (as shown in FIG. 4) of 6 millimeters, and a dimension "x" (as shown in FIG. 4) of 0.5 millimeters. Curve 2 represents the trip time for a shunt of the present invention having a thickness of 1.8 to 2.2 millimeters, a dimension "y" (as shown in FIG. 4) of 6 millimeters, and a dimension "x" (as shown in FIG. 4) of 1 millimeter. Curve 1 represents the trip time for a shunt of the present invention having a thickness of 1.8 to 2.2 millimeters, a dimension "y" (as shown in FIG. 4) of 8 millimeters, and a dimension "x" (as shown in FIG. 4) of 1 millimeter. All of the shunts represented by curves 1–4 are constructed of the same material. The chart of FIG. 5 shows that the shunt of the present invention is a clear improvement over the prior art in that the shunt of the present invention reduces the amount of time to trip the breaker on an overcurrent condition.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A thermal trip unit for actuating a circuit breaker operating mechanism, said thermal trip unit comprising:

a shunt formed from a length of electrically conductive material having a first thickness throughout most of said length;

a bimetallic strip having a first end and a second end, said first end attached to said shunt and said second end arranged to interact with the circuit breaker operating mechanism, said shunt having a section of reduced thickness proximate said first end, said section of reduced thickness having a second thickness of between 20% to 80% of said first thickness.

2. The thermal trip unit of claim 1, wherein said bimetallic strip is in contact with a surface of said shunt over a distance "z" along said length, said section of reduced thickness extends a distance "y" along said length, and said distance "y" is from 3% to 200% of said distance "z".

3. The thermal trip unit of claim 1, wherein said section of reduced thickness extends along an entire width of said shunt.

4. The thermal trip unit of claim 1, further comprising:

first and second slots disposed in said shunt on opposing sides of said section of reduced thickness.

5. A circuit breaker including:

first and second electrical contacts;

an operating mechanism operably connected to said first electrical contact; and a thermal trip unit operably connected to said operating mechanism, said thermal trip unit including:

a shunt electrically connected to said second electrical contact, said shunt formed from a length of electrically conductive material having a first thickness throughout most of said length, said shunt including a section of reduced thickness having a second thickness of between 20% to 80% of said first thickness, and a bimetallic strip having a first end and a second end, said first end attached to said shunt proximate said section of reduced thickness and said second end arranged to interact with said operating mechanism.

6. The circuit breaker of claim 5, wherein said bimetallic strip is in contact with a surface of said shunt over a distance "z" along said length, said section of reduced thickness extends a distance "y" along said length, and said distance "y" is from 3% to 200% of said distance "z".

7. The circuit breaker of claim 5, wherein said section of reduced thickness extends along an entire width of said shunt.

8. The circuit breaker of claim 5, further including:

first and second slots disposed in said shunt on opposing sides of said section of reduced thickness.

* * * * *